US007757630B2

(12) United States Patent
Yoshida et al.

(10) Patent No.: US 7,757,630 B2
(45) Date of Patent: Jul. 20, 2010

(54) VOLTAGE BLOCK DEVICE AND AN ELECTROSTATIC COATING SYSTEM WITH THE VOLTAGE BLOCK DEVICE

(75) Inventors: Yasushi Yoshida, Yokohama (JP); Masahito Ohno, Tokyo (JP); Hidetoshi Kamaru, Yokohama (JP)

(73) Assignee: Ransburg Industrial Finishing K.K. (JP)

( * ) Notice: Subject to any disclaimer, the term of this patent is extended or adjusted under 35 U.S.C. 154(b) by 933 days.

(21) Appl. No.: 10/567,911

(22) PCT Filed: Aug. 12, 2004

(86) PCT No.: PCT/JP2004/011875

§ 371 (c)(1),
(2), (4) Date: Oct. 30, 2006

(87) PCT Pub. No.: WO2005/014178

PCT Pub. Date: Feb. 17, 2005

(65) Prior Publication Data

US 2007/0181716 A1 Aug. 9, 2007

(30) Foreign Application Priority Data

Aug. 12, 2003 (JP) ..... 2003-292489

(51) Int. Cl.
*B05B 5/025* (2006.01)

(52) U.S. Cl. ..... 118/621; 118/629; 239/691; 239/3

(58) Field of Classification Search ..... 118/621; 251/205; 239/3, 690, 691, 708
See application file for complete search history.

(56) References Cited

U.S. PATENT DOCUMENTS 4,304,529 A 12/1981 Gerich
5,725,150 A * 3/1998 Allen et al. ..... 239/3
5,787,928 A 8/1998 Allen et al.
7,296,756 B2 * 11/2007 Scharfenberger ..... 239/3

* cited by examiner

*Primary Examiner*—Parviz Hassanzadeh
*Assistant Examiner*—Albert Hilton
(74) *Attorney, Agent, or Firm*—Lowe Hauptman Ham & Berner, LLP

(57) ABSTRACT

A voltage block device, for preventing the negative electric potential from transferred to the coating material source, has a switching device including a slider which is selectively slidable between first and second positions and has an inlet port fluidly communicated with the coating material source and an outlet port fluidly communicated with the spray, a reservoir including first and second chambers, the inlet and outlet ports are fluidly communicated with the first and second chambers, respectively when the slider is at the first position, and the inlet and outlet ports are fluidly communicated with the second and first chambers, respectively when the slider is at the second position.

15 Claims, 8 Drawing Sheets

VOLTAGE BLOCK DEVICE AND AN ELECTROSTATIC COATING SYSTEM WITH THE VOLTAGE BLOCK DEVICE

RELATED APPLICATIONS

The present application is based on International Application No. PCT/JP04/011875 filed Aug. 12, 2004, and claims priority from, Japanese Application No. 2003-292489 filed Aug. 12, 2003, the disclosure of which is hereby incorporated by reference herein in its entirety.

TECHNICAL FIELD

The present invention relates to an electrostatic coating system, and in particular to a voltage block device used in an electrostatic coating system.

BACKGROUND ART

In an electrostatic coating system, a negative high voltage is applied to a spray to provide a negative electrode and a coating objective article is grounded to provide a positive electrode, and an electric field is formed therebetween. A coating material is sprayed to the coating objective article after it is negatively charged. Recently, in the field of the electrostatic coating, water-based coating material is increasingly used. When a water-based coating material is used in an electrostatic coating system, a voltage block device is disposed between a coating material source and a spray in order to prevent the voltage applied to the coating material in the spray from passing through the conductive water-based coating material to the coating material source.

Japanese Unexamined Patent Publication (Kokai) No. 6-198228 discloses an example of the voltage block device. However, the voltage block device disclosed in Japanese Unexamined Patent Publication (Kokai) No. 6-198228 comprises separately provided first and second transfer units and a switching valve. The disclosed device is very large and therefore requires large footprint for install the device in a paint shop and an increased production cost.

DISCLOSURE OF THE INVENTION

Therefore, the present invention is directed to solve the problems of the voltage block device of the prior art and to provide a compact and efficient voltage block device and an electrostatic coating system including the voltage block device.

In accordance with the present invention, there is provided a voltage block device, used in an electrostatic coating system in which a negative electric potential is applied to a coating material supplied from a coating material source to a spray for spraying the coating material to a coating objective to which a positive electric potential is applied, for preventing the negative electric potential from transferred to the coating material source, comprising;

a switching device including a slider which is selectively slidable between first and second positions and has an inlet port fluidly communicated with the coating material source and an outlet port fluidly communicated with the spray; a reservoir including first and second chambers; the inlet and outlet ports being fluidly communicated with the first and second chambers, respectively when the slider is at the first position; and the inlet and outlet ports being fluidly communicated with the second and first chambers, respectively when the slider is at the second position.

In accordance with another feature of the present invention, there is provided an electrostatic coating system, comprising:

a coating material source; a spray, applied with a negative electric potential, for spraying the coating material from the coating material source to a coating objective, applied with a positive electric potential; and a voltage block device, for preventing the negative electric potential from transferred to the coating material source;

the voltage block device, comprising:

a switching device including a slider which is selectively slidable between first and second positions and has an inlet port fluidly communicated with the coating material source and an outlet port fluidly communicated with the spray;

a reservoir including first and second chambers; the inlet and outlet ports are fluidly communicated with the first and second chambers, respectively when the slider is at the first position; and the inlet and outlet ports are fluidly communicated with the second and first chambers, respectively when the slider is at the second position.

BEST MODE FOR CARRYING OUT THE INVENTION

Figure 1:
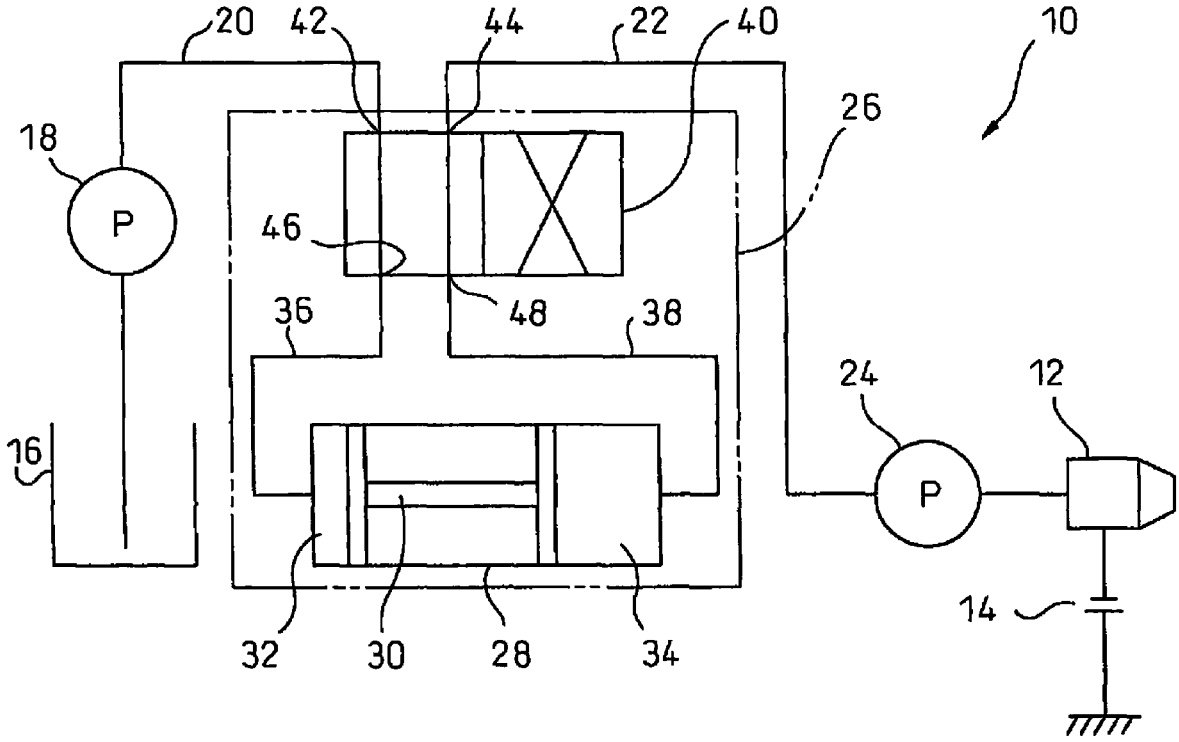
FIG. 1 is a block diagram of an electrostatic coating system according to a preferred embodiment of the invention.

With reference to FIG. 1, an electrostatic coating system 10 according to a first embodiment of the present invention comprises a spray 12 to which a negative DC voltage is applied, a tank 16 as a supply source of a water-based paint, first and second pumps 18 and 24 and a voltage block device 26.

The voltage block device 26 comprises a reservoir 28 and a switching device 40. The switching device 40 comprises a valve which includes an inlet port 42, a outlet port 44 and first and second reservoir ports 46 and 48, and can selectively move between a first position and second position. At the first position, the inlet and outlet ports 42 and 44 are fluidly communicated with the first and second reservoir ports 46 and 48, respectively. At the second position, the inlet and outlet ports 42 and 44 are fluidly communicated with the second and first reservoir ports 48 and 46, respectively.

The reservoir 28 has a cylinder, a double headed piston 30 and first and second chambers 32 and 34 defined by the cylinder and the ends of the double headed piston 30. The first and second chambers 32 and 34 are fluidly communicated with the first and second reservoir ports 46 and 48, respectively through the first and second connection conduits 36 and 38.

With reference to FIGS. 2-6, the voltage block device 26 will be explained in detail below. In this connection, please note that in FIGS. 2-6, the elements forming the voltage block device 26 are indicated by new reference signs different from those in FIG. 1.

Figure 5:
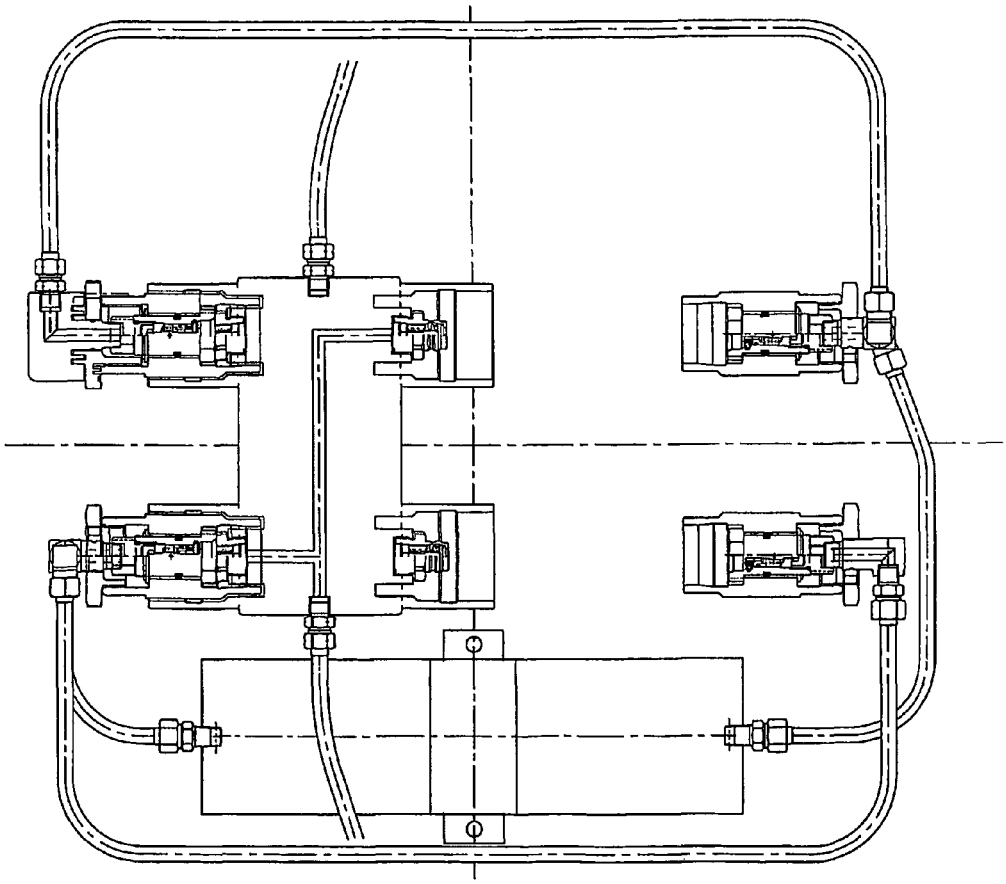
FIG. 5 is a schematic illustration showing the second position of the voltage block device shown in FIG. 2.
Figure 6:
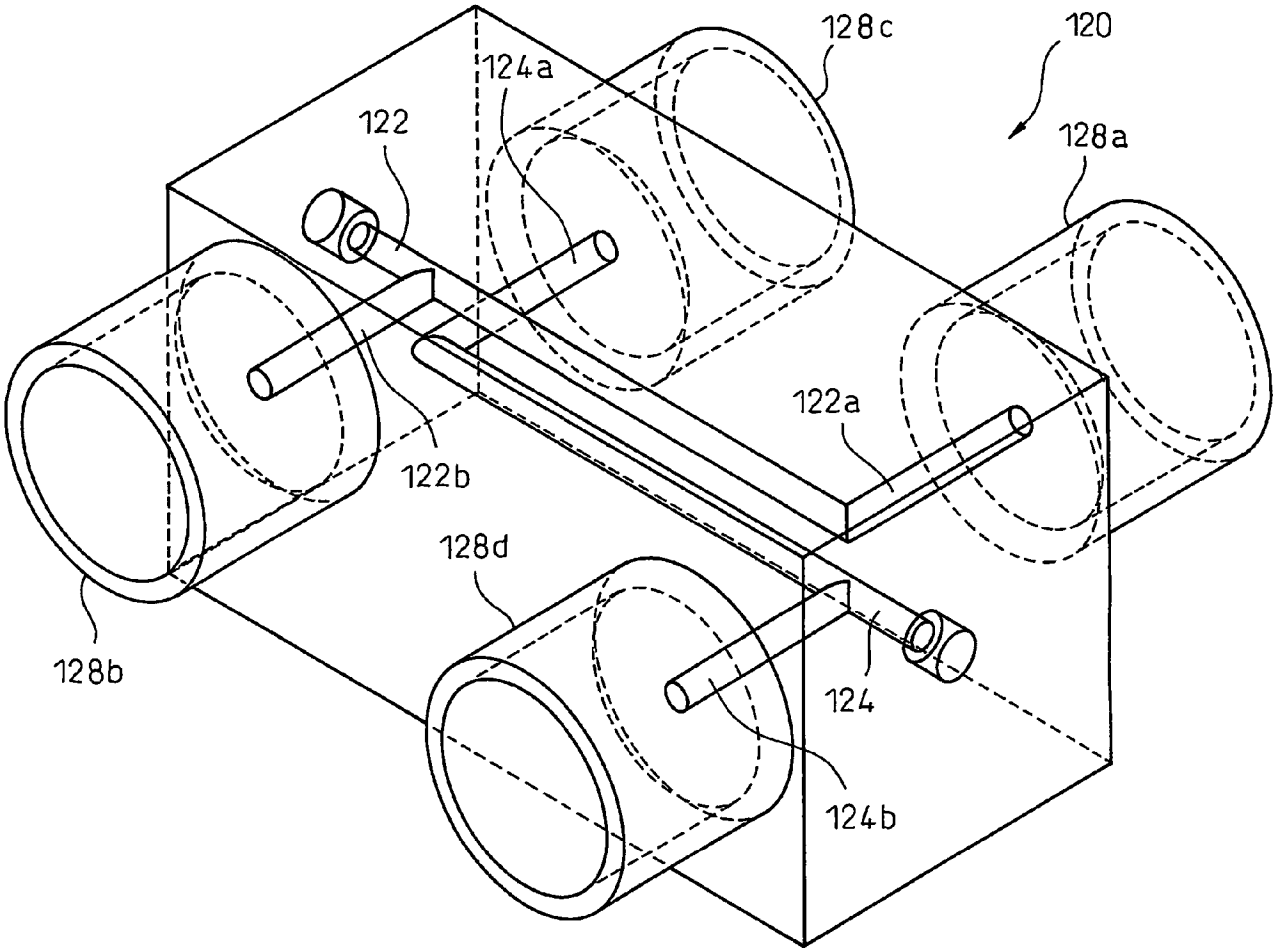
FIG. 6 is a schematic perspective view of a slider of the voltage block device.

The voltage block device 100 comprises a reservoir 110 and a slider 120 made of an insulative material. The slider 120 provides the above-described switching device, and can selectively move between first and second positions, shown in FIGS. 2 and 3 and FIGS. 4 and 5, respectively. Further, the slider 120 includes an inlet passage 122, providing the inlet port 42 in FIG. 1, and a outlet passage 124, providing the outlet port 44 in FIG. 1. The inlet and outlet passages 122 and 124 are apart from each other in the vertical direction, as shown in FIG. 6. The inlet passage 122 is fluidly connected to a coating material source (tank 16 and pump 18) through a flexible conduit 102 and the outlet passage 124 is fluidly connected to a spray (spray 12) through the flexible conduit 104.

The first and second passages 122*a* and 122*b* are connected to the inlet passage 122 and third and fourth passages 124*a* and 124*b* are connected to the outlet passage 124. Moving quick couplers 126*a*-126*d* are provided at the ends of the first to fourth passages 122*a*, 122*b*, 124*a* and 124*b* so that the moving quick couplers 126*a*-126*d* are coupled to and decoupled from corresponding stationary quick couplers 132*a*-132*d* in accordance with the position of slider 120.

The stationary quick coupler 132*a* is fluidly connected to the first chamber of the reservoir 110 through a joint 130*a*, a conduit 114*b*, a three-way joint 118*a*, a conduit 114*a* and a joint 112*a*. The stationary quick coupler 132*b* is fluidly connected to the second chamber of the reservoir 110 through a joint 130*b*, a conduit 116*b*, a three-way joint 118*b* and a conduit 116*a* and a joint 112*b*. The stationary quick coupler 132*c* is fluidly connected to the second chamber of the reservoir 110 through a three-way joint 118*b*, a conduit 116*a* and the joint 112*b*. The stationary quick coupler 132*d* is fluidly connected to the first chamber of reservoir 110 through a three-way joint 118*a*, a conduit 114*a* and the joint 112*a*.

Stationary shielding members 134*a*-134*d* made of an insulative material are provided to surround the stationary quick couplers 132*a*-132*d*. Moving shielding members 128*a*-128*d* made of an insulative material are mounted to the slider 120 so as to surround the moving quick couplers 126*a*-126*d*. When the slider 120 is at the first position, the moving shielding members 132*a* and 132*c* are fitted onto the stationary shielding members 134*a* and 134*c*, and the moving shielding members 132*b* and 132*d* are decoupled from the stationary shielding members 134*b* and 134*d*. On the other hand, when the slider 120 is at the second position, the moving shielding members 132*a* and 132*c* are decoupled from the stationary shielding members 134*a* and 134*c*, and the moving shielding members 132*b* and 132*d* are fitted onto the stationary shielding members 134*b* and 134*d*.

Figure 2:
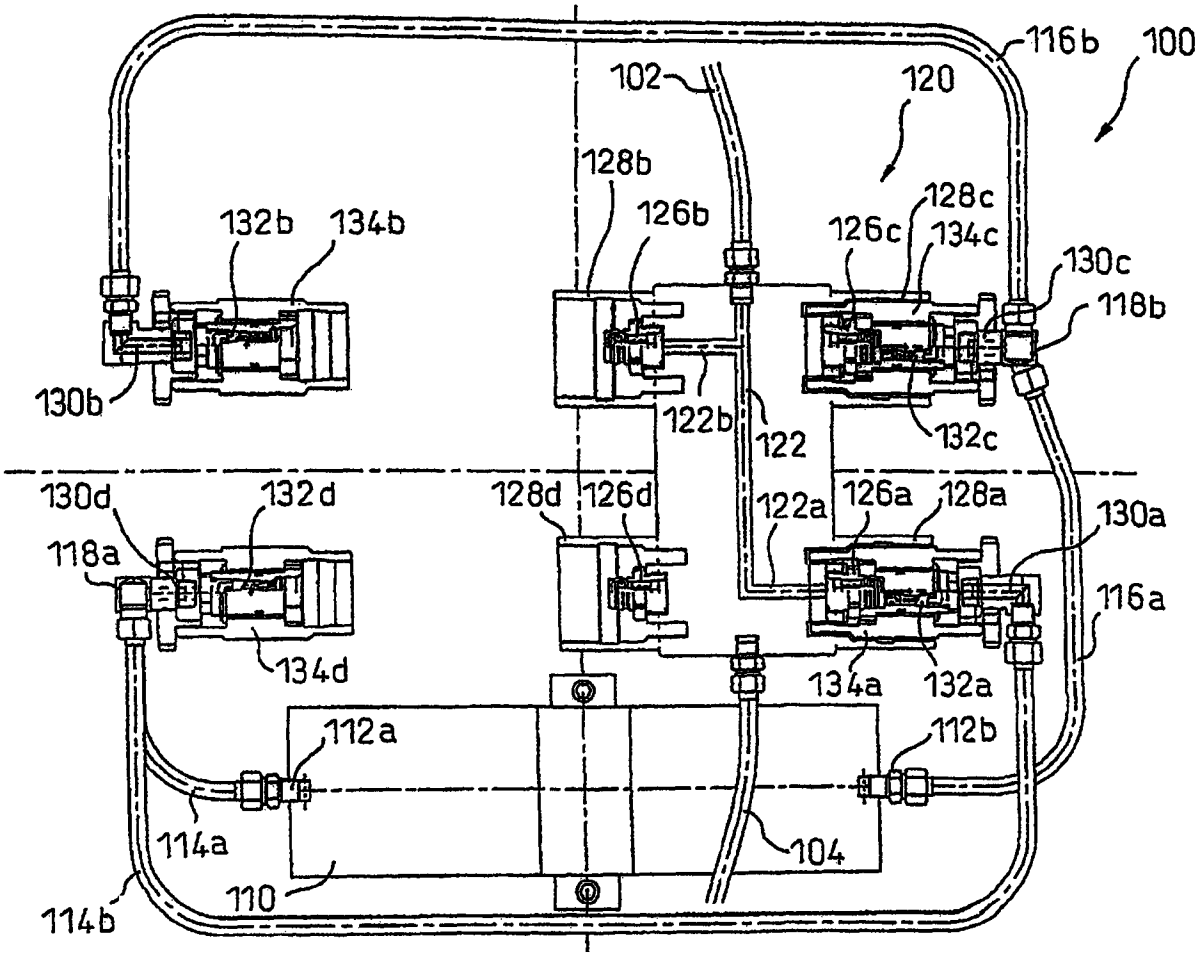
FIG. 2 is a schematic illustration showing a first position of a voltage block device according to a first embodiment of the invention.
Figure 3:
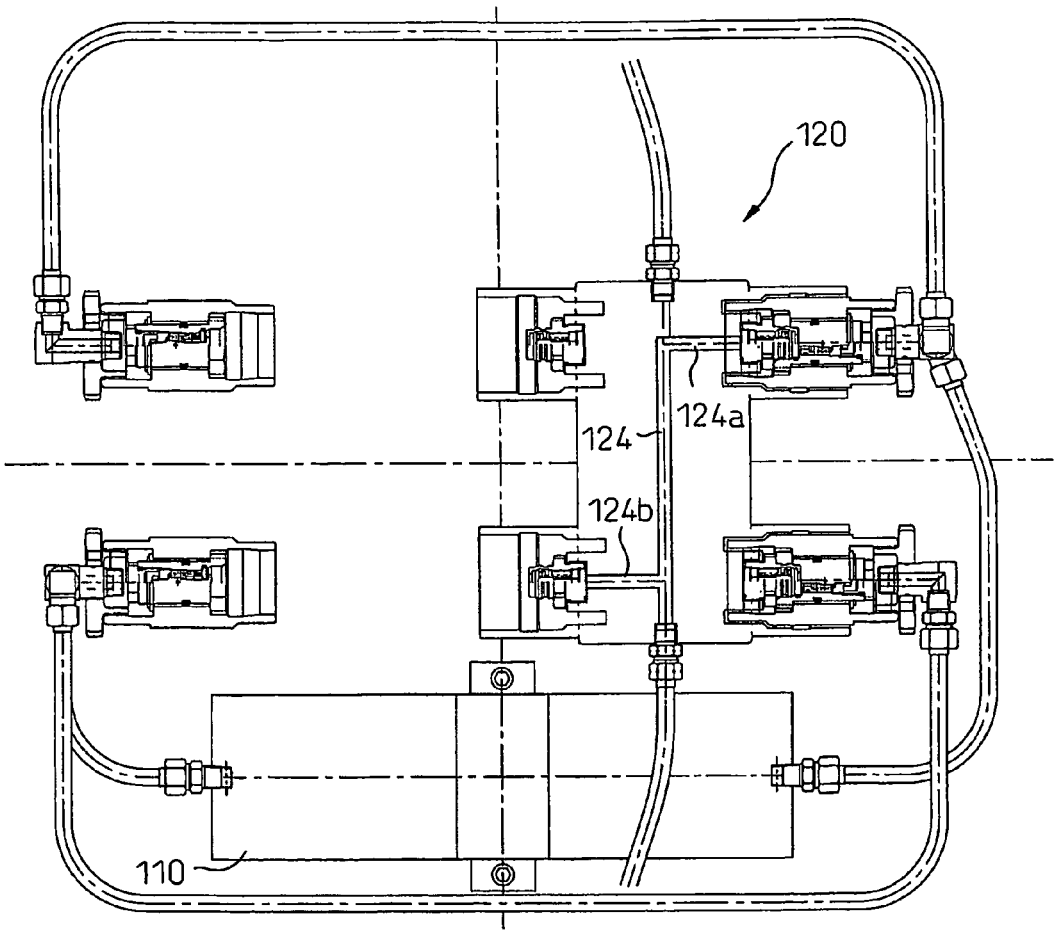
FIG. 3 is a schematic illustration showing the first position of the voltage block device shown in FIG. 2.

When slider 120 is at the first position (FIGS. 2 and 3), the moving quick coupler 126*a* is coupled to the stationary quick coupler 132*a*, and the moving quick coupler 126*d* is decoupled from the stationary quick coupler 132*d* whereby the first chamber of reservoir 110 is fluidly connected to the coating material source through the joint 112*a*, the conduit 114*a*, the three-way joint 118*a*, the conduit 114*b*, the joint 130*a*, the quick coupler 132*a*, the quick coupler 126*a*, the first passage 122*a*, the inlet passage 122 and the flexible conduit 102, as shown in FIG. 2. On the other hand, the moving quick coupler 128*c* is coupled to the quick stationary coupler 132*c*, and the quick coupler 126*b* is decoupled from the quick coupler 132*b* whereby the second chamber of the reservoir 110 is fluidly connected to the spray through the joint 112*b*, the conduit 116*a*, the three-way joint 118*b*, the quick coupler 132*c*, the quick coupler 126*c*, the third passage 124*a*, the outlet passage 124 and the flexible conduit 104, as shown in FIG. 3.

Figure 4:
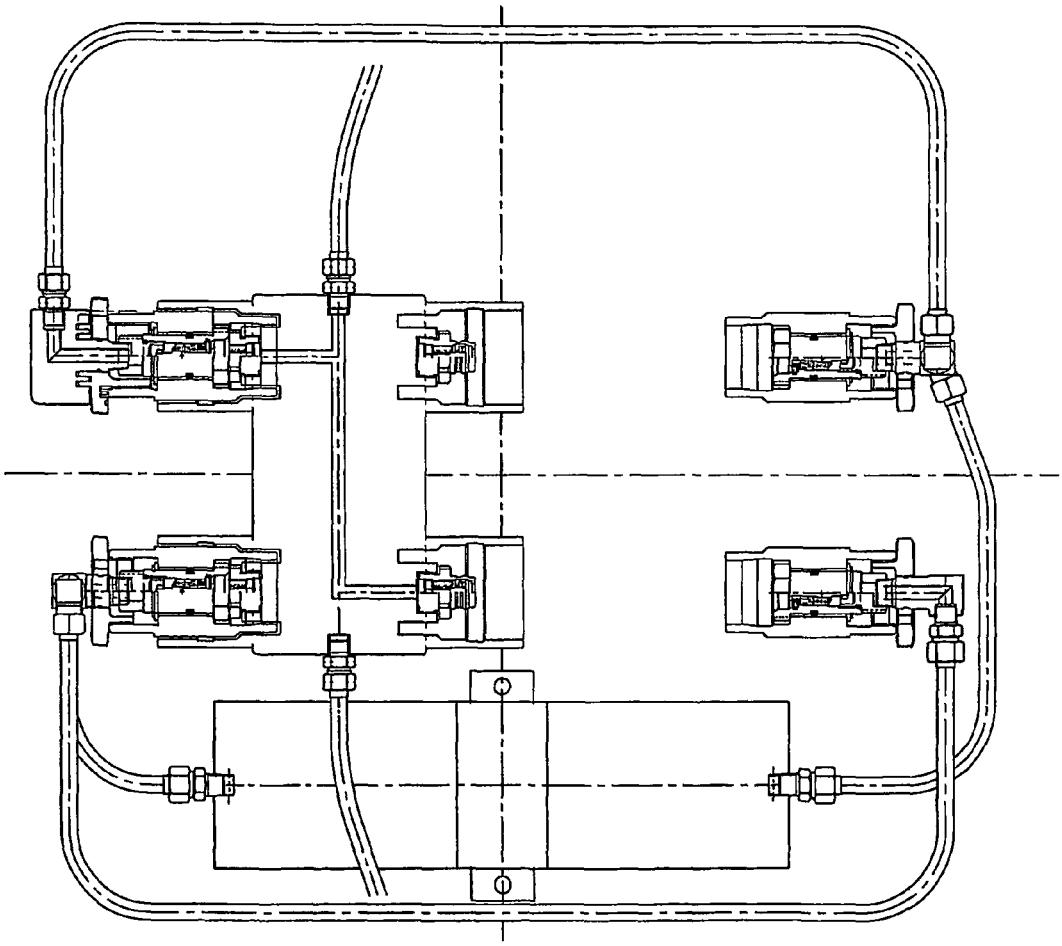
FIG. 4 is a schematic illustration showing a second position of the voltage block device shown in FIG. 2.

When slider 120 is at the second position (FIGS. 4 and 5), the moving quick, coupler 126*a* is decoupled from the stationary quick coupler 132*a*, and the moving quick coupler 126*d* is coupled to the stationary quick coupler 132*d* whereby the first chamber of the reservoir 110 is fluidly connected to the spray through the joint 112*a*, the conduit 114*a*, the three-way joint 118*a*, the quick coupler 132*d*, the quick coupler 126*d*, the fourth passage 124*b*, the outlet passage 124 and the flexible conduit 104, as shown in FIG. 4. On the other hand, the moving quick coupler 128*c* is decoupled from the stationary quick coupler 132*c*, and the moving quick coupler 126*b* is coupled to the stationary quick coupler 132*b* whereby the second chamber of the reservoir 110 is fluidly connected to the coating material source through the joint 112*b*, the conduit 116*a*, the three-way joint 118*b*, the conduit 116*b*, the quick coupler 132*b*, the quick coupler 126*b*, the second passage 124*b*, the inlet passage 122 and the flexible conduit 102, as shown in FIG. 5.

Figure 7:
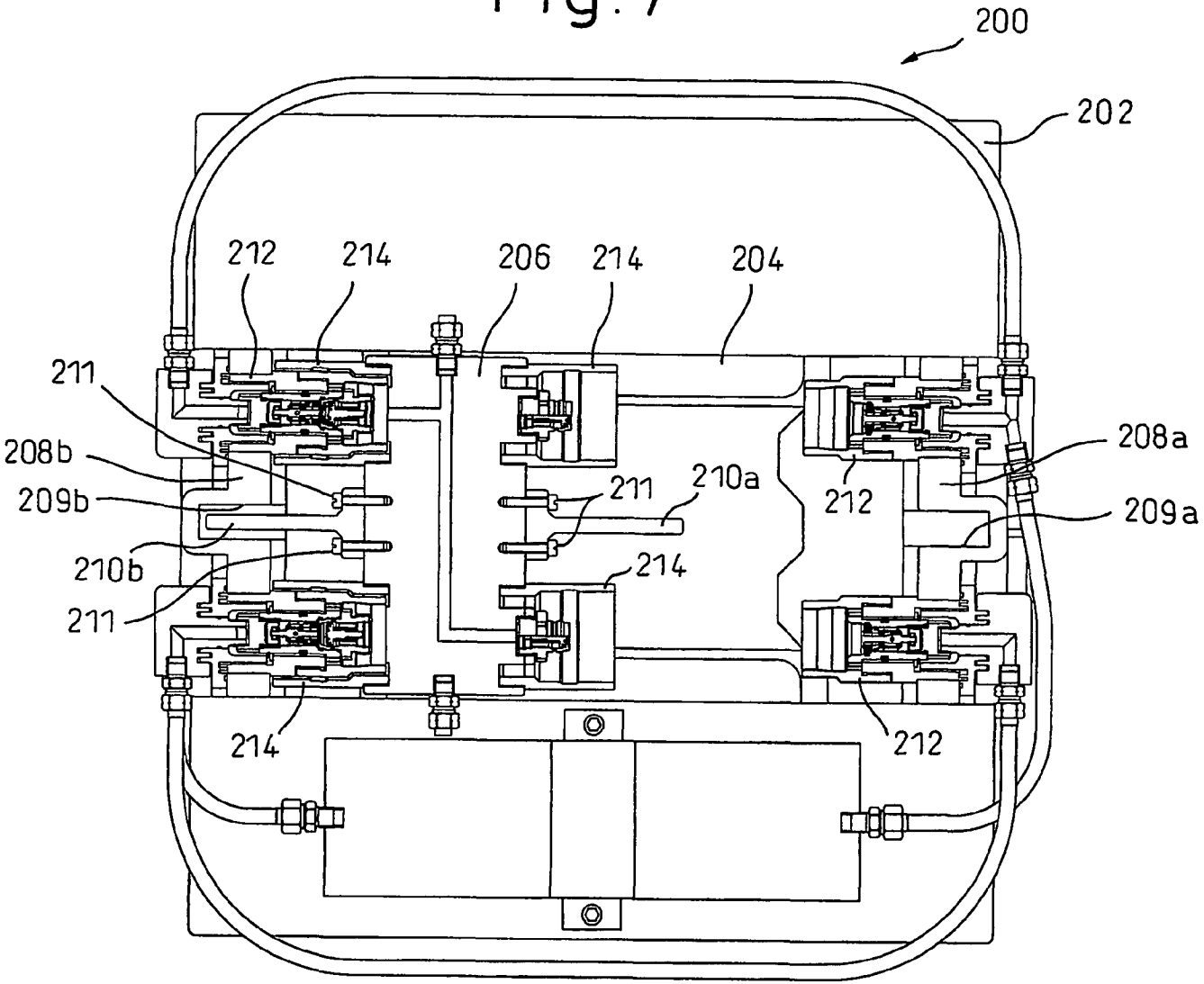
FIG. 7 is a plan view similar to FIG. 2 of a voltage block device according to a second embodiment of the invention.
Figure 8:
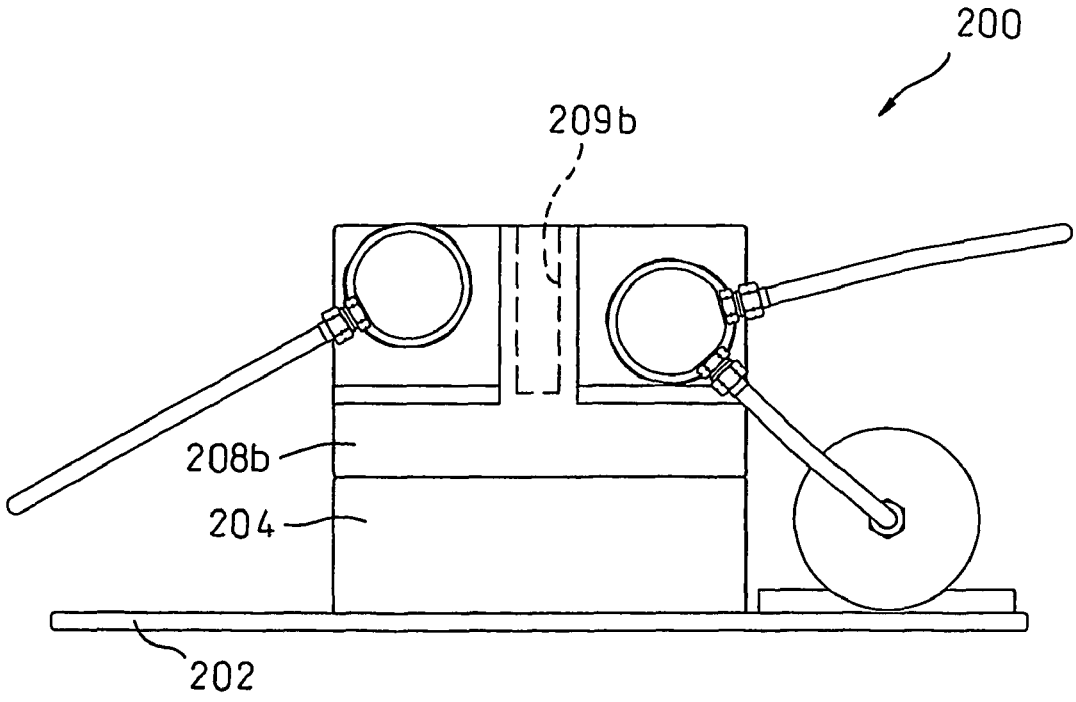
FIG. 8 is a side view of the voltage block device shown in FIG. 7.

With reference to FIGS. 7 and 8, a voltage block device according to a second embodiment of the invention will be described below. The second embodiment is configured substantially the same as the first embodiment, and therefore only the difference between the first and second embodiment will be described below.

In FIGS. 7 and 8, the voltage block device 200 comprises a mounting plate 202 for mounting the voltage block device 200 to a frame member (not shown) of the electrostatic coating system or to a column of a spray shop where the electrostatic coating system. A base member 204 is secured to the mounting plate 202. A slider 206 similar to the slider 120 is slidably mounted to the base member 204, and can selectively move between the first position and second position similar to the first embodiment.

The second embodiment shown in FIGS. 7 and 8 is configured substantially the same as the first embodiment, except that the voltage block device 200 comprises additional shielding members 208 and 210. The additional shielding members comprises stationary shielding members 208*a* and 208*b* attached to the base member 204 and moving shielding members 210*a* and 210*b* attached to the slider 206. Each of the stationary shielding members 208*a* and 208*b* includes a recess 209*a* and 209*b* for receiving each of the moving shielding members 210*a* and 210*b*. When the slider 206 is at the first position, the stationary shielding member 210*a* is received in the recess 209*a*. When the slider 206 is at the second position, the stationary shielding member 210*b* is received in the recess 209*b*.

The invention claimed is:

1. A voltage block device, configured for use in an electrostatic coating system in which a negative electric potential is applied to a coating material supplied from a coating material source to a spray device configured to spray the coating material to a coating object to which a positive electric potential is applied, the voltage block device configured to prevent the negative electric potential from transferred to the coating material source, comprising:

a switching device including a linear slider which is selectively slidable between first and second positions, an inlet port in fluidic communication with the coating material source, and an outlet port in fluidic communication with the spray device;

a reservoir including first and second chambers;

the inlet and outlet ports in fluidic communication with the first and second chambers, respectively, when the slider is at the first position; and the inlet and outlet ports in fluidic communication with the second and first chambers, respectively~when the slider is at the second position.

2. A voltage block device according to claim 1, the reservoir comprising a cylinder and a double headed piston slidable within the cylinder so that an inner wall of the cylinder and the ends of the double headed piston defines the first and second chambers in the cylinder.

3. A voltage block device according to claim 1, wherein the slider comprises a body defining a bottom surface facing to the base member, a top surface opposite to the bottom surface, opposing first and second surfaces that extend between the bottom and top surfaces transversely relative to a direction of the motion of the slider;

the body further defining inlet and outlet passages extending in the body and define the inlet and outlet ports;

the voltage block device further comprising first and second moving quick couplers which are attached to the opposing first and second surfaces, respectively, and fluidly connect to the inlet passage;

third and fourth moving quick couplers which are attached to the opposing first and second surfaces, respectively, and fluidly connect to the outlet passage;

first and second stationary quick couplers which are fluidly connected to the first and second chambers of the reservoir, respectively;

third and fourth stationary quick couplers which are fluidly connected to the second and first chambers of the reservoir, respectively;

the first and third moving quick couplers being coupled to the first and third stationary quick couplers and the second and fourth moving quick couplers being decoupled from the second and fourth stationary quick couplers when the body is at the first position; and the first and third moving quick couplers being decoupled from the first and third stationary quick couplers and the second and fourth moving quick couplers being coupled to the second and fourth stationary quick couplers when the body is at the second position.

4. A voltage block device according to claim 3, the voltage block device further comprising a first moving shielding member attached to the opposing first and second surfaces around each of the first to fourth moving quick couplers.

5. A voltage block device according to claim 4, the voltage block device further comprising a first stationary shielding member surrounding the first to fourth stationary quick couplers.

6. A voltage block device according to claim 5, the voltage block device further comprising second moving shielding members attached to the opposing first and second surfaces between the first and third moving quick couplers and second and fourth moving quick couplers respectively.

7. An electrostatic coating system, comprising: a coating material source; a spray device, applied with a negative electric potential, the spray device configured to spray the coating material from the coating material source to a coating object, applied with a positive electric potential; and a voltage block device, configured to prevent the negative electric potential from being transferred to the coating material source:

the voltage block device, comprising:

a switching device including a linear slider which is selectively slidable between first and second positions, an inlet port in fluidic communication with the coating material source, and an outlet port in fluidic communication with the spray device;

a reservoir including first and second chambers;

wherein the inlet and outlet ports fluidly communicate with the first and second chambers, respectively, when the slider is at the first position; and the inlet and outlet ports fluidly communicate with the second and first chambers, respectively when the slider is at the second position.

8. An electrostatic coating system according to claim 7, the reservoir comprising a cylinder and a double headed piston slidable within the cylinder so that an inner wall of the cylinder and the ends of the double headed piston defines the first and second chambers in the cylinder.

9. An electrostatic coating system according to claim 7, wherein the slider comprises:

a body defining a bottom surface facing to the base member, a top surface opposite to the bottom surface, opposing first and second surfaces which extend between the bottom and top surfaces transversely relative to a direction of the motion of the slider;

the body further defining inlet and outlet passages extending in the body and providing the inlet and outlet passage;

the voltage block device further comprising first and second moving quick couplers which are attached to the opposing first and second surfaces respectively and fluidly connect to the inlet passage;

third and fourth moving quick couplers which are attached to the opposing first and second surfaces respectively and fluidly connect to the outlet passage;

first and second stationary quick couplers that are fluidly connected to the first and second chambers of the reservoir respectively;

third and fourth stationary quick couplers that are fluidly connected to the second and first chambers of the reservoir, respectively;

the first and third moving quick couplers being coupled to the first and third stationary quick couplers and the second and fourth moving quick couplers being decoupled from the second and fourth stationary quick couplers when the body is at the first position; and the first and third moving quick couplers being decoupled from the first and third stationary quick couplers and the second and fourth moving quick couplers being coupled to the second and fourth stationary quick couplers when the body is at the second position.

10. An electrostatic coating system according to claim 9, the voltage block device further comprising a first moving shielding member attached to the opposing first and second surfaces around each of the first to fourth moving quick couplers.

11. An electrostatic coating system according to claim 10, the voltage block device further comprising a first stationary shielding member surrounding the first to fourth stationary quick couplers.

12. An electrostatic coating system according to claim 11, the voltage block device further comprising second moving shielding members attached to the opposing first and second surfaces between the first and third moving quick couplers and second and fourth moving quick couplers respectively.

13. A voltage block device according to claim 3, the reservoir comprising a cylinder and a double headed piston slidable within the cylinder so that the inner wall of the cylinder and the ends of the double headed piston defines the first and second chambers in the cylinder.

14. An electrostatic coating system according to claim 9, the reservoir comprising a cylinder and a double headed piston slidable within the cylinder so that the inner wall of the cylinder and the ends of the double headed piston defines the first and second chambers in the cylinder.

15. a switching device including a linear slider which is selectively slidable between first and second positions, an inlet port fluidly communicated with the coating material source, and an outlet port fluidly communicated with the spray device;

a reservoir comprising a cylinder and a double headed piston slidable within the cylinder so that an inner wall of the cylinder and ends of the double headed piston define first and second chambers in the cylinder, the cylinder having two and only two fluid communicating ports, the two—and only two fluid communicating ports consisting of a first port providing access to/from the first chamber at one end of the cylinder and a second port providing access to/from the second chamber at the other end of the cylinder;

the inlet and outlet ports being fluidly communicated with the first and second chambers, respectively, when the slider is at the first position; and the inlet and outlet ports being fluidly communicated with the second and first chambers, respectively, when the slider is at the second position.

* * * * *